United States Patent [19]

Kojima et al.

[11] Patent Number: 4,458,487

[45] Date of Patent: Jul. 10, 1984

[54] ELECTROMAGNETIC ACTUATOR

[75] Inventors: Tadashi Kojima; Tetsuo Uchihama, both of Fujisawa; Kazuyoshi Tanaka, Yokohama; Eiichi Morozumi, Ayase; Kentaro Inoue, Yokohama; Hitoshi Tanaka, Kamakura; Shyuji Morio, Yokohama; Shunji Ichida, Kamakura, all of Japan

[73] Assignee: Honeywell Inc., Minneapolis, Minn.

[21] Appl. No.: 361,928

[22] PCT Filed: Oct. 31, 1981

[86] PCT No.: PCT/JP81/00316

§ 371 Date: Mar. 15, 1982

§ 102(e) Date: Mar. 15, 1982

[87] PCT Pub. No.: WO82/01577

PCT Pub. Date: May 13, 1982

[30] Foreign Application Priority Data

| | | | |
|---|---|---|---|
| Oct. 31, 1980 | [JP] | Japan | 55-154521 |
| Nov. 12, 1980 | [JP] | Japan | 55-161709 |
| Nov. 14, 1980 | [JP] | Japan | 55-160405 |
| Nov. 14, 1980 | [JP] | Japan | 55-160411 |
| Jan. 20, 1981 | [JP] | Japan | 56-5966 |

[51] Int. Cl.[3] ..... F16D 31/02

[52] U.S. Cl. ..... 60/477; 60/494

[58] Field of Search ..... 417/417, 388; 251/30; 60/477, 491

[56] References Cited

U.S. PATENT DOCUMENTS

| | | | |
|---|---|---|---|
| 1,346,898 | 7/1920 | Kingsbury | 417/36 X |
| 3,118,383 | 1/1964 | Woodward | 417/417 X |
| 3,415,487 | 12/1968 | Robarge | 251/30 X |
| 3,516,332 | 6/1970 | Ray | 91/446 X |
| 3,842,601 | 10/1974 | Borst | 417/50 X |
| 3,871,176 | 3/1975 | Schukei | 417/50 X |
| 4,241,644 | 12/1980 | Schertler | 91/447 |

FOREIGN PATENT DOCUMENTS

| | | |
|---|---|---|
| 1049314 | 11/1966 | United Kingdom . |
| 1474758 | 5/1977 | United Kingdom . |

*Primary Examiner*—Carlton R. Croyle
*Assistant Examiner*—Donald E. Stout
*Attorney, Agent, or Firm*—Alfred N. Feldman

[57] ABSTRACT

An electromagnetic actuator utilizing a fluid pressure obtained from an electromagnetic pump, wherein according to the present invention, there is provided a responsive member displaceable in response to the pressure of a fluid forced into a second chamber from a first chamber. The responsive member displaceable as described can operate a valve member or the like coupled thereto in an on-off control or a proportional control with a large stroke in a reliable manner.

7 Claims, 11 Drawing Figures

ELECTROMAGNETIC ACTUATOR

FIELD OF THE TECHNIQUE

This invention relates to an electromagnetic actuator which controls a load such as a valve by use of a fluid pressure established by the operation of an electromagnetic pump.

BACKGROUND OF THE INVENTION

Various actuators have been heretofore used for controlling a load such as a valve in accordance with an electric signal. Among these actuators, those of a construction having a driven member secured to a plunger driven by an electromagnetic force created by an electromagnetic coil are used most widely. However, in an actuator of such a conventional construction, when it is desired to drive a member to be driven in a large stroke, the axial length of the electromagnetic coil inevitably increases, thus increasing the size of the actuator and reducing the stability of the same. Furthermore, servomotors widely used for a proportional control of a driven member are formed disadvantageous when a large driving force is required, and it is difficult to maintain the driven member stably at a predetermined position by use of the servomotor.

On the other hand, the fluid pressure obtained by an electromagnetic pump is required to be maintained at a constant value, and it has been a conventional practice to detect the delivery side pressure of the electromagnetic pump, and to vary the pulse width of a pulse current based on the detected pressure for maintaining a constant pressure at the delivery side of the electromagnetic pump.

For realizing such a feature, the driving device of the electromagnetic pump has been so constructed that it comprises a monostable multivibrator driven under the control of a pulse signal generated from a self-running multivibrator, and that the time-constant of the monostable multivibrator is controlled so as to vary the pulse width of the pulse current delivered the monostable multivibrator.

However, the resistance of the coil of the electromagnetic pump is varied in accordance with the temperature rise of the coil, and therefore the current flowing through the coil is varied regardless of the constant pulse width of the pulse current supplied from the driving device so as to vary the delivery of the electromagnetic pump, such a feature constituting a drawback of the conventional construction.

SUMMARY OF THE INVENTION

An object of the present invention is to provide an electromagnetic actuator which is capable of not only driving a driven member in a large stroke, but also capable of maintaining the driven member at a predetermined position.

Another object of the present invention is to provide an electromagnetic actuator which can displace a valve member at a predetermined velocity in response to an electric signal, and also can prevent the valve member from being held at an opening position even in a case of a fault occurring in the actuator.

Still another object of the invention is to provide an electromagnetic actuator which can proportionally control a load according to an electric proportional control signal, and the operation of which is extremely stable.

Still another object of the invention is to provide an electromagnetic actuator which can control a damper of a damper device with a high reliability.

A further object of the present invention is to provide an electromagnetic actuator which can assure a stable delivery of an electromagnetic pump.

According to an embodiment of the present invention, there is provided an electromagnetic actuator which comprises an electromagnetic pump for supplying a fluid from a first chamber to a second chamber in accordance with an output of a driving device; a passage interconnecting the first and second chambers; a responsive load means comprising a responsive member responsive to a pressure in the second chamber, and a load driven by the responsive member, and operable for controlling the mechanical displacement of the load; and a flow-rate control means provided in the passage for maintaining the pressure in the second chamber at a predetermined value.

According to another embodiment of the present invention there is provided an electromagnetic actuator which comprises an electromagnetic pump for forcing a fluid through a first passage from a first chamber to a second chamber under operation of a plunger and a check valve reciprocable at a frequency corresponding to that of a driving signal supplied to an exciting coil of the pump; a second passage provided in the electromagnetic pump for by-passing the check valve so as to inter connect the first and second chambers; a movable member which closes the second passage under a magnetic force of the exciting coil when a driving signal is applied to the exciting coil, and thereby elevates the pressure in the second chamber; a responsive member displaced in response to the pressure in the second chamber; and a responsive load means including a coupling member for mechanically coupling the responsive member to a load.

DESCRIPTION OF PREFERRED EMBODIMENTS OF THE INVENTION

Figure 1:
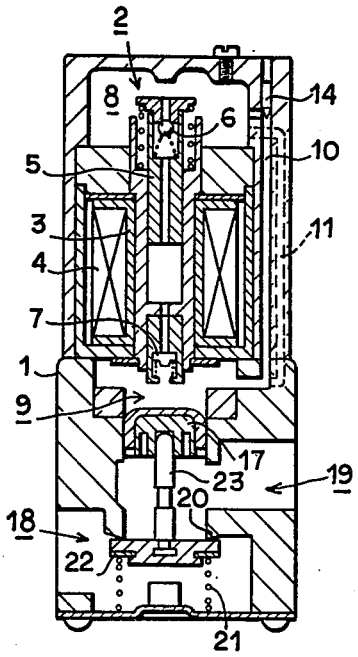
FIG. 1 is a longitudinal sectional view of a fluid on-off electromagnetic valve according to one embodiment of the present invention.

In FIG. 1 showing a preferred embodiment of the present invention, an electromagnetic pump 2 is provided in a casing 1. The electromagnetic pump 2 comprises an electromagnetic coil 4 wound around a coil bobbin 3, and a plunger 5 provided in a control hole of the coil bobbin 3. Two check valves 6 and 7 are provided in the plunger 5. Upon application of a predetermined driving signal to the coil 4, the plunger 5 reciprocates in the axial directions thereby forcing a fluid in a first chamber 8 communicating with an entrance side piping (not shown) to a second chamber 9.

Figure 2:
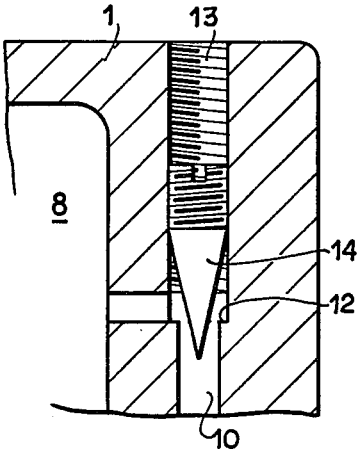
FIG. 2 is a longitudinal sectional view showing a part of FIG. 1 on a much enlarged scale.
Figure 3:
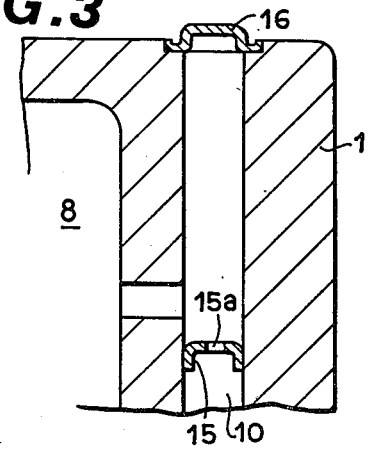
FIG. 3 is a longitudinal sectional view showing one part of a modification of the present invention.

Two fluid passages 10 and 11 are provided through the thickness of the wall of the casing 1 for sending back the fluid in the second chamber 9 to the first chamber 8. The first passage 10 has a bending portion as shown in FIG. 2, in detail, having an upper end bent at right angles. An opening 12 is provided for the first passage 10 at the bending portion, which in combination with a screw-threaded needle 14 driven into a threaded hole 13 formed in the thickness of the casing 1 provides a needle valve for the passage 10. By varying the position of the needle 14 along the axis thereof, the opening area of the needle valve is varied. The flow resistance of the passage 10 for the fluid returning from the second chamber 9 to the first chamber 8 is thereby regulated, and the fluid pressure in the second chamber 9 can be thereby varied as desired. In a case where no variation in setting the pressure in the second chamber 9 is required, a member 15 having an orifice 15*a* may be settled in the passage 10, and the hole 13 communicating the passage 10 to the outside of the casing 1 may be closed by a cap 16 (see FIG. 3).

Within the casing 1, a responsive member 17 displaceable in response to the fluid pressure in the second chamber 9 is provided. The responsive member 17, which could be made of a flexible material is coupled through a rod 23 to a valve member 22 which is urged by a spring 21 to a valve seat 20 formed between an inlet port 18 and a delivery port 19 of the electromagnetics valve of this invention. In the state shown in FIG. 1 where the valve member 22 is urged by the spring 21 to the valve seat 20, the delivery port 19 is interrupted from the inlet port 18.

In an electromagnetic on-off valve as described above, upon application of a predetermined driving signal to the coil 4 of the electromagnetic pump 2, the plunger 5 of the pump 2 pumps the fluid in the first chamber 8 to the second chamber 9. The fluid returns from the second chamber 9 to the first chamber 8 through the fluid passages 10 and 11 under a predetermined flow resistance of these passages thereby circulating within the on-off valve. The pressure in the second chamber thus goes up, and the responsive member 17 is thereby displaced downwardly against the force of the spring 21. The downward displacement of the responsive member 17 moves the valve member 22 downwardly out of the valve seat 20, and causes a second fluid supplied into the inlet port 18 to flow out of the delivery port 19. When the plunger 5 stops its movement, the pumping operation from the first chamber 8 to the second chamber 9 terminates, thus reducing the pressure in the second chamber 9. Upon reduction of the pressure in the second chamber 9, the spring 21 brings the responsive member 17 and the valve member 22 back to their original positions so as to interrupt the delivery of the second fluid out of the delivery port 19.

The above mentioned second passage 11 provided in a parallel relation with the first passage 10 prevents the pressure in the second chamber 9 from being held at a high value when dust or the like substance blocks the flow of the fluid through the first passage 10.

Figure 4:
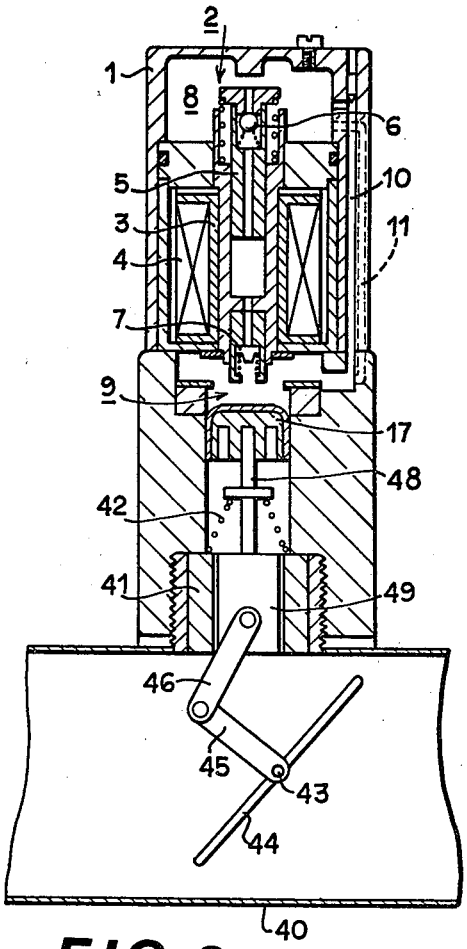
FIG. 4 is a longitudinal sectional view showing a damper driving device constituting another embodiment of the present invention.

FIG. 4 shows a modified embodiment of FIG. 1 in the form of an electromagnetic actuator which actuates a damper as its load. In this embodiment, a responsive member 17 responsive to the pressure in a second chamber 9 is provided in a casing 1, and the responsive member 17 is coupled through a rod 48 to a movable member 49. In a boss (or sleeve) 41 provide for a pipe or duct 40 through which a fluid to be controlled flows, the movable member 49 is movable in a direction perpendicular to the central axis of the pipe or duct 40. A spring 42 provided between the rod 48 and the boss 41 urges the responsive member 17 and hence the movable member 49 in a direction to protrude upward into the second chamber 9. A damper 44 provided in the duct 40 to be rotatable around a shaft 43 has an arm 45 extending in a direction perpendicular to the damper 44, and the end of the arm 45 is coupled to the movable member 49 through a link 46. Thus, when the movable member 49 moves, the damper 44 is rotated around the shaft 43 thereby to regulate the quantity of the fluid flowing through the duct 40.

Figure 5:
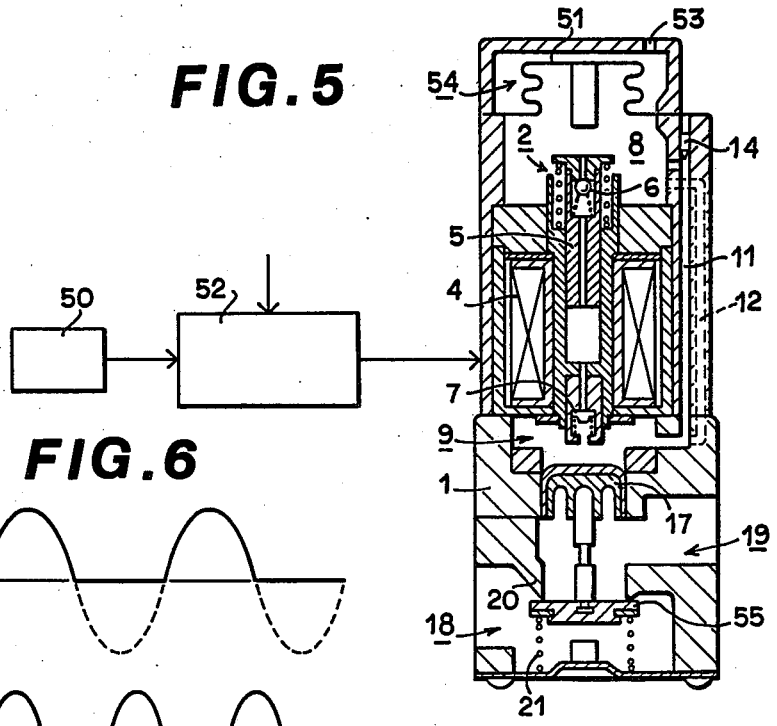
FIG. 5 is a longitudinal sectional view of a proportional control actuator constituting still another embodiment of the invention.

In FIG. 5, there is illustrated still another embodiment of the present invention having a casing 1 wherein is provided an electromagnetic pump 2 which in combination with a control circuit being described thereinafter constitutes an electromagnetic pumping device. The electromagnetic pump 2 comprises a coil 4 to which a proportion signal from a control circuit 52 is applied, and a plunger 5 reciprocable in a central part of the coil 4. When the plunger 5 reciprocates, a fluid (for instance, oil) in a first chamber 8 communicating with the suction side of the pump 2 is pumped into a second chamber 9 communicating with the delivery side of the pump 2. Based on a proportional control signal, the control circuit 52 produces a proportion signal out of a current delivered from a power source 50, and supplies the proportion signal to the coil 4 of the electromagnetic pump 2 for controlling the quantity of the fluid sent from the first chamber 8 to the second chamber 9.

The second chamber 9 communicates through two passages 11 and 12 with the first chamber 8. Preferably, a flow rate control member such as an orifice or a needle 14 is provided in the passage 11 for maintaining the fluid pressure in the second chamber 9 at a predetermined value.

In the casing 1, there is further provided a responsive member 17 which can be displaced in response to the pressure in the second chamber 9. The responsive member 17 is coupled through a rod 16 to a valve member 55 which constitutes a load in this example. A spring 21 urges the valve member 55 to a valve seat 20 formed between an inlet port 18 and a delivery port 19.

A diaphragm 51 is further provided for absorbing a variation in the quantity of the fluid contained in the first chamber 8, and a third chamber 54 formed between the diaphragm 51 and the casing 1 is communicated with outside through a bleeding hole 53.

Figure 6:
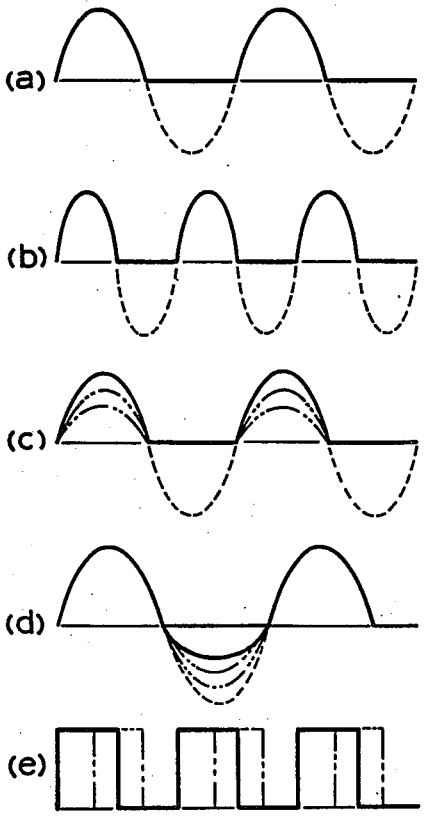
FIG. 6(*a*) through 6(*e*) are diagrams showing various waveforms of a signal supplied to the proportional control actuator shown in FIG. 5.

In a proportionally operated actuator of the above described construction, if a suitable proportional signal, such as a signal corresponding to half waves of an AC signal as shown in FIG. 6(*a*), is applied from the control circuit 52 to the coil 4 of the electromagnetic pump 2, the plunger 5 reciprocates at a frequency corresponding to that of the proportion signal and at a stroke corresponding to the amplitude of the same signal so that it pumps a quantity of the fluid corresponding to the proportion signal from the first chamber 8 to the second chamber 9. The fluid thus forced to the second chamber 9 is sent back to the first chamber 8 through the passages 11 and 12 against a flow resistance thereof of a predetermined valve. By the above described circulation of the fluid, the fluid pressure in the second chamber 9 is maintained at a value corresponding to the proportion signal, and the responsive member 17 is thereby displaced against the force of the spring 21 so as to open the valve member 55 to a predetermined extent.

Figure 7:
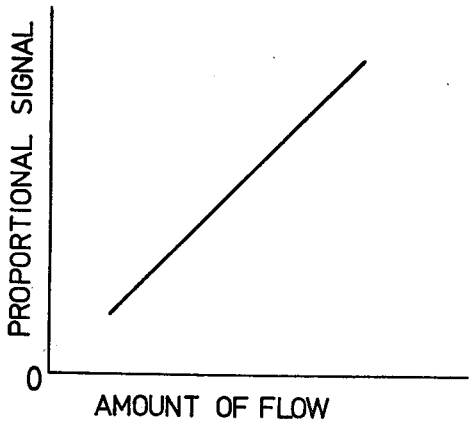
FIG. 7 is a graphical representation of discharged quantity of a fluid and intensity of a proportion signal.

Since the quantity of the fluid sent from the first chamber 8 to the second chamber 9 is varied in accordance with the parameters such as the frequency and stroke of the reciprocation of the plunger 5, it is possible to proportionally control the pressure in the second chamber 9, and hence the opening of the valve member 55, by varying either one or both of the frequency and amplitude of the proportion signal applied to the coil 4 of the electromagnetic pump 2. For example, the frequency of the proportion signal may be varied as shown in FIG. 6(*b*), or the amplitude thereof may be varied as shown in FIG. 6(*c*). Furthermore, it is also possible to vary the quantity of the fluid by applying a proportion signal containing a negative component as shown in FIG. 6(*d*). In a case applying a rectangular signal as shown in FIG. 6(*e*), the frequency of the signal may be kept to a constant value and the pulse width or amplitude of the signal may be varied for varying the quantity of the fluid. By controlling the pressure in the second chamber 9 as described above, the flow rate of a fluid delivered from the delivering port 19 can be controlled in a proportional manner as shown in FIG. 7 against a proportion signal applied to the coil 4.

Figure 8:
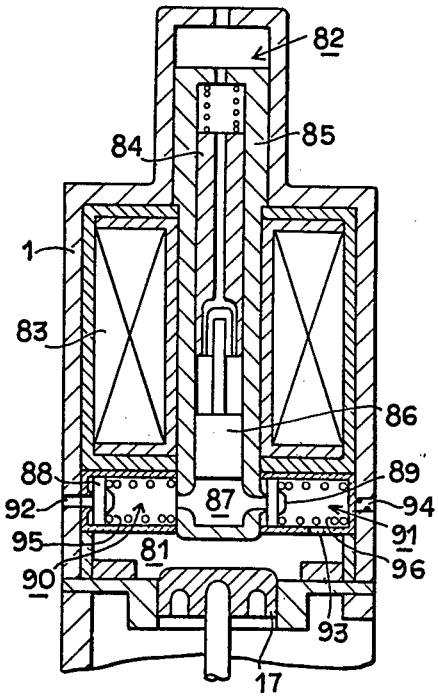
FIG. 8 is a longitudinal sectional view showing one part of still another embodiment of the present invention.

FIG. 8 shows still another embodiment of the present invention wherein an electromagnetic compressor 82 forcing air to a pressurized chamber 18 corresponding to the second chamber 9 is used instead of the electromagnetic pump 2 in the embodiment shown in FIG. 5. The compressor 82 comprises an electromagnetic coil 83 receiving a proportion signal, and a cylindrical member 85 supporting a plunger 84 reciprocable in the coil 83. The plunger 84 is coupled to a piston 86 movable in the cylindrical member 85. The reciprocating movement of the piston 86 alternately increases or decreases the pressure in a cylinder chamber 87 formed internally of the cylindrical member 85. The cylinder chamber 87 communicates with a suction chamber 90 and an exhaust chamber 91 having check valves 88 and 89 respectively. The suction chamber 90 opens toward outside through a suction hole 92, while the exhaust chamber 91 communicates with a pressurized chamber 81 through an exhaust hole 93. The exhaust chamber 91 further communicates with outside through a passage 94 having a flow-rate limiting device such as an orifice. The check valve 88 is urged by a spring 95 in a direction closing the suction hole 92, while the check valve 89 is urged by another spring 96 in a direction closing a passage between the cylinder chamber 87 and the exhaust chamber 91.

Upon application of a proportion signal to the coil 83, the plunger 84 and the piston 86 coupled thereto are reciprocated. The reciprocation of the piston 86 sends air supplied through the suction hole 92 to the pressurized chamber 81 so as to increase the pressure in the chamber 81. More specifically, when the piston 86 moves upward as shown in FIG. 8, the pressures in the cylinder chamber 87 and the suction chamber communicating therewith are reduced. The reduction of the pressures open the check valve 88 thereby introducing outside air through the suction hole 92. While lowering of the piston 86, the piston 86 compresses air in the cylinder chamber 87 and the suction chamber 90, and maintains the check valve 88 at a position closing the suction hole 92. At the same time, the compressed air in the cylinder chamber 90 moves the check valve 89 against the force of the spring 96 and opens the passage between the cylinder chamber 87 and the exhaust chamber 91. Thus the air in the cylinder chamber 87 is forced into the exhaust chamber 91 and then through the exhaust hole 93 into the pressurized chamber 81, while one part of air in the exhaust chamber 91 is exhausted outside through a passage 94. When the pressure in the pressurized chamber 81 goes up as a result of the above described operation, it depresses the responsive member 17 downwardly. The downward movement of the responsive member 17 moves a valve member coupled thereto in an opening direction of the valve.

Although the above description discloses a case where a valve member is used as a load of this embodiment, it is apparent that the embodiment may also be utilized for other loads such as a damper and the like.

Figure 9:
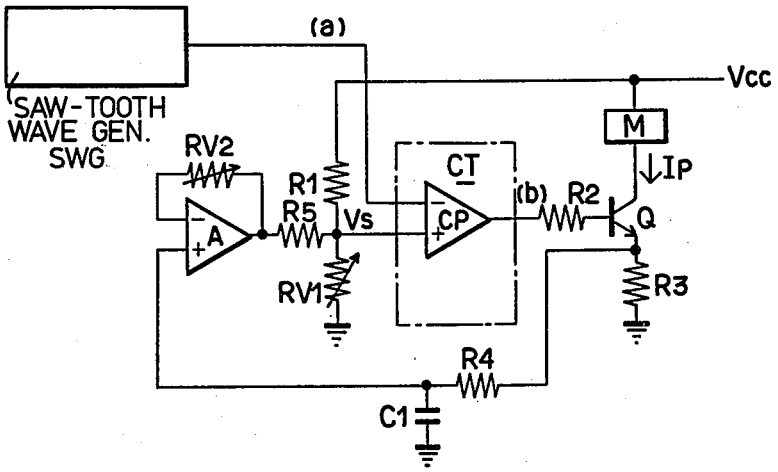
FIG. 9 is a circuit diagram of an electromagnetic pump driving circuit constituting still another embodiment of the invention.
Figure 10:
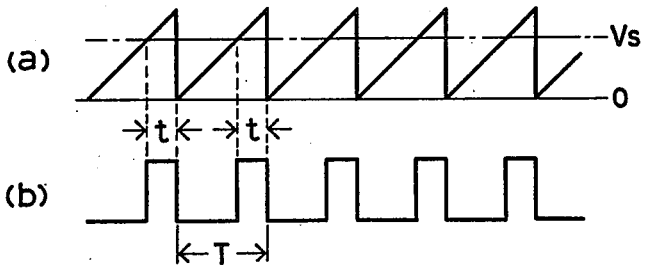
FIGS. 10(*a*) and 10(*b*) are diagrams showing waveforms of signals presenting at different parts of the circuit shown in FIG. 9.

In FIG. 9, there is illustrated, in the form of a block diagram, a driving circuit of the electromagnetic pump constituting still another embodiment of the invention, and FIG. 10 illustrates waveforms of signals occurring at various parts of the circuit shown in FIG. 9.

The driving circuit shown in FIG. 9 comprises a control circuit CT including a comparator CP, a saw-tooth wave generator SWG delivering an output voltage to an input terminal of the comparator CP, and a power source supplying a power source voltage $V_{cc}$ divided by a resistor $R_1$ and a variable resistor $RV_1$ to another input terminal of the comparator CP as a set voltage $V_s$. When an instantaneous valve of a saw-tooth signal (a) delivered from the saw-tooth wave generator SWG becomes higher than the set voltage $V_s$, the output of the comparator CP goes up and the control circuit CT delivers a pulse signal (b). The pulse width t of the pulse signal (b) is varied in accordance with the set voltage $V_s$, so that the area of each pulse is varied according to the variation of the variable resistor $RV_1$ regardless of a constant cycle period T of the pulse signal (b), and the effective valve of the pulse signal (b) is also varied according to the variation.

For this reason, when the pulse signal (b) is applied through a resistor $R_2$ to the base of a transistor Q, the transistor Q ON-OFF operates in response to the pulse signal (b) so as to flow a pulse current $I_p$ having a waveform similar to that of the pulse signal (b) through a winding M of the electromagnetic pump. The effective valve of the pulse current $I_p$ is varied in accordance with the variation of the variable resistor $RV_1$, and therefore the delivery of the electromagnetic pump is controlled by the variable resistor $RV_1$.

The pulse current $I_p$ is detected as a terminal voltage of a resistor $R_3$ and is changed into an average value by an integrating circuit comprising a resistor $R_4$ and a capacitor $C_1$. The output of the integrating circuit is applied to an operational amplifier A having a negative feed-back through a variable resistor $RV_2$. The output of the operational amplifier A is fed-back to a junction point between the resistor $R_1$ and the variable resistor $RV_1$. Thus when the amplitude of the pulse current $I_p$ increases, the set voltage $V_s$ increases thereby reducing the pulse width t as is apparent from FIG. 10. Since the pulse width t of the pulse current $I_p$ is reduced as described above regardless of an increase in the amplitude of the pulse current $I_p$, the pulse area of the pulse current $I_p$ is not varied as well as the effective valve of the same, and hence the delivery of the electromagnetic pump is maintained at a constant valve.

Furthermore, the gain of the operational amplifier A is varied by the variation of the variable resistor $RV_2$, and the valve of feed back in the amplifier A is thereby adjusted in a direction resulting a constant delivery of the electromagnetic pump.

Although the feed back circuit has been composed of resistors $R_4$ and $R_5$, a capacitor $C_1$, an operational amplifier A and the like, it is apparent that various different compositions may also be utilized. Likewise, any other circuit capable of varying the effective value of the current pulse determined by the pulse area and the cycle period T may also be used as the control circuit CT, and a triangular wave generator or a pulse generator when the condition allows may be utilized instead of the saw-tooth wave generator SWG.

Figure 11:
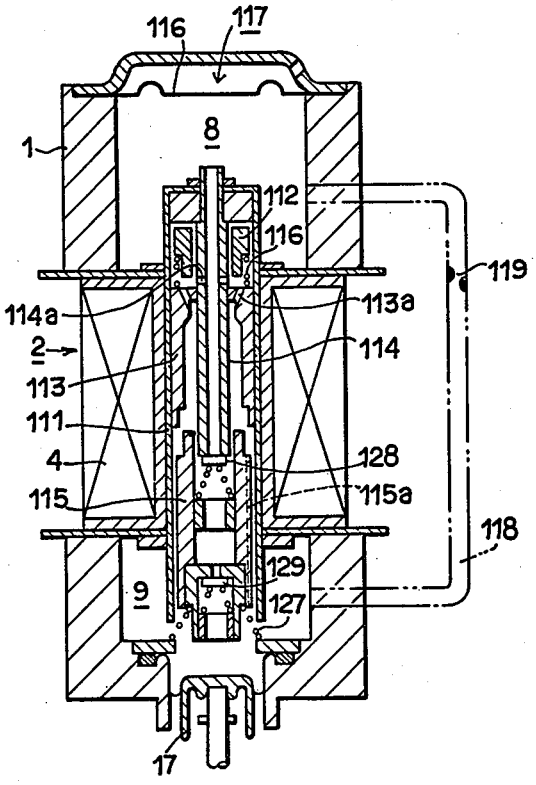
FIG. 11 is a longitudinal sectional view of an actuator constituting still another embodiment of the invention.

FIG. 11 illustrates still another embodiment of the invention operable as an actuator. In the drawing, numeral 1 designates a casing in which an electromagnetic pump 2 is provided. Upon reception of a driving signal from outside, the electromagnetic pump 2 forces a fluid (for instance, oil) contained in a first chamber 8 provided in the casing 1 into a second chamber 9, and a fluid pressure established in the second chamber 9 displaces a responsive member 17. An air chamber 117 is provided adjacent to the first chamber 8 with a diaphragm 116 being interposed therebetween. The air chamber 117 absorbs a variation in the quantity of the fluid contained in the first chamber 8. A first fluid passage 118 is provided for returning the fluid from the second chamber 9 to the first chamber 8, and a predetermined flow resistance is imparted, for instance, by an orifice to the fluid flowing through the passage 118.

The electromagnetic pump 2 comprises a coil 4 for receiving a driving signal from outside and a cylindrical supporting member 111 passing through a central part of the coil 4. Within the supporting member 111 are provided a movable member 112, a sleeve 113, a cylindrical member 114 and a plunger 115 in a concentrical relation. The sleeve 113 and the cylindrical member 114 are fixed to the cylindrical supporting member 111, while the movable member 112 and the plunger 115 are movable in predetermined ranges respectively along the length of the supporting member 111 and urged respectively by the springs 116 and 127 toward the first chamber 8.

Central holes of the cylindrical member 114 and the plunger 115 provide a first passage for sending this fluid from the first chamber 8 to the second chamber 9. Check valves 128 and 129 provided in the plunger 115 normally close the first passage. The plunger 115 has on its peripheral surface a groove 115*a* extending in its axial direction, and this groove 115*a* together with a space between the cylindrical member 114 and the sleeve 113, fluid passages 113*a* formed in the sleeve 113, and fluid passages 114*a* formed in the cylindrical member 114 provides a second passage for by-passing the check valves 128 and 129. In a state where no driving current flows in the coil 4, the spring 116 holds the movable member 112 at a position shown in FIG. 11 opening the fluid passage 114*a*.

When a driving signal is applied to the coil 4, the electromagnetic force created in the coil 4 shifts the movable member 112 downwardly against the force of the spring 116 so as to close the fluid passage 114*a* for closing the second passage. The plunger 115 reciprocates at a frequency corresponding to that of the driving signal applied to the coil 4 for sending the fluid from the first chamber 8 to the second chamber 9. The fluid forced into the second chamber 9 is sent back to the first chamber 8 under a predetermined flow resistance through the first passage 118, thus establishing a pressure in the second chamber 9 causing a downward movement of the responsive member 17.

When the driving signal is removed, the operation of the plunger 115 terminates, and the movable member 112 goes up under the force of the spring 16 so as to open the fluid passage 114*a*. Thus, the fluid in the second chamber 9 is sent back to the first chamber 8 through the first passage 118 and also the above described second passage.

According to the present invention, the responsive member is displaced by a pressure of the fluid sent by the electromagnetic pump from the first chamber to the second chamber, so that the valve member connected to the responsive member is driven by the responsive member to its opening or closing position. Accordingly, although the electromagnetic pump is of a small size, a large value of the moving stroke can be set for the valve member without fear of becoming unstable. Furthermore, the moving velocities of the responsive member and the valve member coupled thereto can be adjusted as described by varying the delivery of the electromagnetic pump or the magnitude of the flow resistance in the first fluid passage. Likewise, the setting of the moving velocity of the responsive member can be selected as desired by varying the frequency or peak value of the driving signal and thereby varying the flow rate of the fluid delivered in accordance with the reciprocating movement of the plunger. By varying the frequency or peak value suitably, it is also possible to maintain the responsive member at a desired position.

The second passage by-passing the check valves is, under the action of the movable member, closed at the time of operation of the plunger and opened when the operation of the plunger terminates. Accordingly, rising-up and falling down of the pressure in the second chamber can be carried out promptly, thus rendering a high response of the actuator.

The displacement of the load is obtained in accordance with the movement of the responsive member under action of a fluid pressure established in a chamber by an electromagnetic pump or an electromagnetic compressor, so that the displacement of the load corresponds to a proportion signal applied to the electromagnetic pump or compressor. Accordingly, the displacement of the load is accurately proportional to the proportion signal. Further, a sufficiently large driving force and stroke can be imparted to the load, and the operation of the actuator is sufficiently stable.

According to the present invention, a pulse current flowing through the coil of an electromagnetic pump is detected, and the thus detected current is fed back to the control circuit. For this reason, the operation of this invention is not sensitive to a resistance variation of the coil or a voltage variation of the power source, and the delivery of the electromagnetic pump can be maintained at a constant value regardless of a variation in the temperature or in the power source voltage.

What I claim is:

1. An electromagnetic actuator comprising:

an electromagnetic pump for continuously supplying a fluid from a first chamber to a second chamber in accordance with an output of a driving device;

a passage interconnecting said first and second chambers;

a responsive load means comprising a responsive member responsive to a pressure in said second chamber and a load driven by said responsive member, and operable for controlling the mechanical displacement of said load; and a flow-rate control means provided in said passage for maintaining the pressure in said second chamber at a determined value.

2. An electromagnetic actuator as set forth in claim 1 wherein said flow-rate control means is an orifice.

3. An electromagnetic actuator as set forth in claim 2 wherein said responsive load means comprises said responsive member and a slidable rod mechanically linked thereto, and said responsive member is made of a flexible material.

4. An electromagnetic actuator as set forth in claim 3 wherein said driving device comprises a control circuit which generates an output pulse current and varies effective value of said pulse current for controlling the delivery of said electromagnetic pump, and a feed-back circuit which detects said current flowing through the electromagnetic winding of said pump and feeds it back to said control circuit in a direction maintaining said delivery of said pump at a constant value.

5. An electromagnetic actuator as set forth in claim 4 wherein said output pulse current obtained from said control circuit is a controlling output for controlling said slidable rod in a two-position control or a proportional control manner.

6. An electromagnetic actuator as set forth in claim 5 wherein said load is a valve device or a damper for controlling flow rate of a fluid.

7. An electromagnetic actuator comprising:

an electromagnetic pump for continuously forcing a fluid through a first passage from a first chamber to a second chamber under operation of a plunger and a check valve reciprocable at a frequency corresponding to that of a driving signal supplied to an exciting coil of said pump;

a second passage provided in said electromagnetic pump for by-passing said check valve so as to interconnect said first and second chambers;

a movable member which closes said second passage under a magnetic force of said exciting coil when a driving signal is applied to said exciting coil, and thereby elevates the pressure in said second chamber;

a responsive member displaced in response to the pressure in said second chamber; and a responsive load means including a coupling member for mechanically coupling said responsive member to a load.

* * * * *

UNITED STATES PATENT AND TRADEMARK OFFICE

CERTIFICATE OF CORRECTION

PATENT NO. : 4,458,487

DATED : July 10, 1984

INVENTOR(S) : TADASHI KOJIMA ET AL

It is certified that error appears in the above-identified patent and that said Letters Patent is hereby corrected as shown below:

INID Code 73 Assignee, delete "Honeywell Inc."

and insert --Yamatake-Honeywell Co., Ltd.--.

Claim 1, line 18, delete "determined" and insert

--predetermined--.

Signed and Sealed this

*Fifteenth* Day of *January 1985*

[SEAL]

*Attest:*

*Attesting Officer*

GERALD J. MOSSINGHOFF

*Commissioner of Patents and Trademarks*